US006309038B1

(12) United States Patent
Domenig

(10) Patent No.: US 6,309,038 B1
(45) Date of Patent: Oct. 30, 2001

(54) SWINGING DRAWER FOR KITCHEN CABINETS AND SUCHLIKE

(75) Inventor: Georg Domenig, Kernersville, NC (US)

(73) Assignee: Grass GmbH, Kernersville, NC (US)

( * ) Notice: Subject to any disclaimer, the term of this patent is extended or adjusted under 35 U.S.C. 154(b) by 0 days.

(21) Appl. No.: 09/533,469

(22) Filed: Mar. 23, 2000

(30) Foreign Application Priority Data

Apr. 17, 1999 (DE) ..... 299 06 934

(51) Int. Cl.[7] ..... A47B 88/18
(52) U.S. Cl. ..... 312/246; 312/325
(58) Field of Search ..... 312/245, 246, 312/247, 248, 266, 277, 319.1, 319.4, 325

(56) References Cited

U.S. PATENT DOCUMENTS

| | | | | |
|---|---|---|---|---|
| 876,159 | * | 1/1908 | Erickson | 312/266 X |
| 1,100,329 | * | 6/1914 | Sellers | 312/266 X |
| 2,919,966 | * | 1/1960 | Preston | 312/266 X |
| 4,723,680 | * | 2/1988 | Carroll et al. | 312/248 X |
| 5,228,763 | * | 7/1993 | Gingold | 312/266 |
| 5,758,782 | * | 6/1998 | Rupert | 312/248 X |

* cited by examiner

*Primary Examiner*—Peter M. Cuomo
*Assistant Examiner*—Michael J. Fisher

(57) ABSTRACT

A swinging drawer takes the form of an upper open compartment that is fastened to the underside of an upper wall cabinet/furniture such as, for example, an upper kitchen cabinet that is attached or hung on a wall.

11 Claims, 6 Drawing Sheets

SWINGING DRAWER FOR KITCHEN CABINETS AND SUCHLIKE

BACKGROUND OF THE INVENTION

The present invention is a swinging drawer that takes the form of an upper open compartment that is fastened to the underside of an upper wall cabinet/furniture such as, for example, an upper kitchen cabinet that is attached or hung on a wall.

A swinging drawer of this type is an advantageous complement to kitchen cabinets because it allows the existing space underneath the kitchen cabinets to be well utilized and can be subsequently attached to existing kitchen cabinets.

The task of the present invention is a swinging drawer of the aforementioned type, which can be attached to an open compartment on already existing kitchen cabinet and utilized immediately, is very accessible to the user and can be assembled easily and inexpensively.

The solution to the presented task of the invention is identified by the features declared in Protection claim 1.

SUMMARY OF THE INVENTION

The invention is based on the swinging drawer that is fastened by means of assembly units that are located on one or both sides of the cabinet's/furniture's component side walls. The assembly unit includes a screw-down angle located on the cabinet side and a bearing plate located on the drawer side, so that both parts are connected hinge-mounted or swivel-mounted by a parallelogram linkage or rod.

The invention is advantageous because the assembly unit already contains the complete mechanism needed for the movable attachment of the swinging drawer to the cabinet; basically, no additional parts are necessary to fasten the swinging drawer to the cabinet. The swinging drawer can be assembled easily and, above all, quickly to the cabinet with the two assembly units, so that even a subsequent assembly of the swinging drawer can be accomplished at any time.

When the drawer is closed, the drawer's upper edge fits to the upper edge of the cabinet piece so that the upper open side of the drawer is covered by the cabinet piece, and the contents of the drawer are protected and covered. When the drawer is closed, the corresponding arms of the parallelogram linkages or rods are hidden because they are angled backwards directed towards the compartment.

In the open state, that is, when the drawer opens, it swings forward and outward and rises away from the cabinet's underside so that the length of the parallelogram linkages' or rods' arms and/or the position of its fulcrum in the screw-down angle and/or in the bearing plate are designed so that the swinging drawer, when open, is slightly tilted towards the user and projects out from the front edge of the cabinet component. This results in an advantageous ergonomic access to the contents in the drawer, as well as making the drawer's contents very visible and available to the user.

This special swinging-out and forward tilting of the open drawer is achieved because the front arm of the parallelogram linkage or rod, that lies closer to the front wall, is designed longer than the back arm. In order to keep the parallelogram linkage or rod stable, the respective arms can be connected together with the opposite-located assembly units by turn-connected or swivel-connected rods or linkages.

Especially when the drawers must carry heavy loads, the parallelogram rods or linkages are provided with a counterweight in the form of a torsion spring and/or draw spring. This counterweight prevents the heavily laden swinging drawer from suddenly swinging or falling down when the drawer is opened, but ensures that the drawer swings out slowly with the counter-force.

In another preferred embodiment, stops and/or support shanks, formed on the bearing plate, are located on the inner side of the back wall or, respectively, on the upper edge of the side wall of the swinging drawer, resulting in a slight alignment of the bearing plate during the assembly that stabilizes the fastening even more.

Advantageously, the opened drawer has at least one functioning, cushioning stop that absorbs the kinetic energy of the drawer when it swings out to the open position and reduces the speed of the drawer and brakes it.

In order to keep the drawer in its closed position on the cabinet, it has a locking device that is located in about the center of the front side of the drawer and has a pivotable, manually activated closing lever stored in a rocker system. When the drawer is closed, this catch lever engages with a closing angle that is provided on the cabinet side. The locking device is designed advantageously so that it is accessible (respectively, the access to the catch lever) in the drawer's bottom area, and also, so that it is easy and simple to activate. At the same time, the drawer can be opened by activating the catch mechanism manually.

BRIEF DESCRIPTION OF THE FIGURES

The invention at hand will be explained more precisely by the various embodiments shown by the representational drawings. Hereby, additional significant features and advantages of the invention will be concluded from the drawings and their descriptions. Shown.

DETAILED DESCRIPTION OF THE INVENTION

Figure 1:
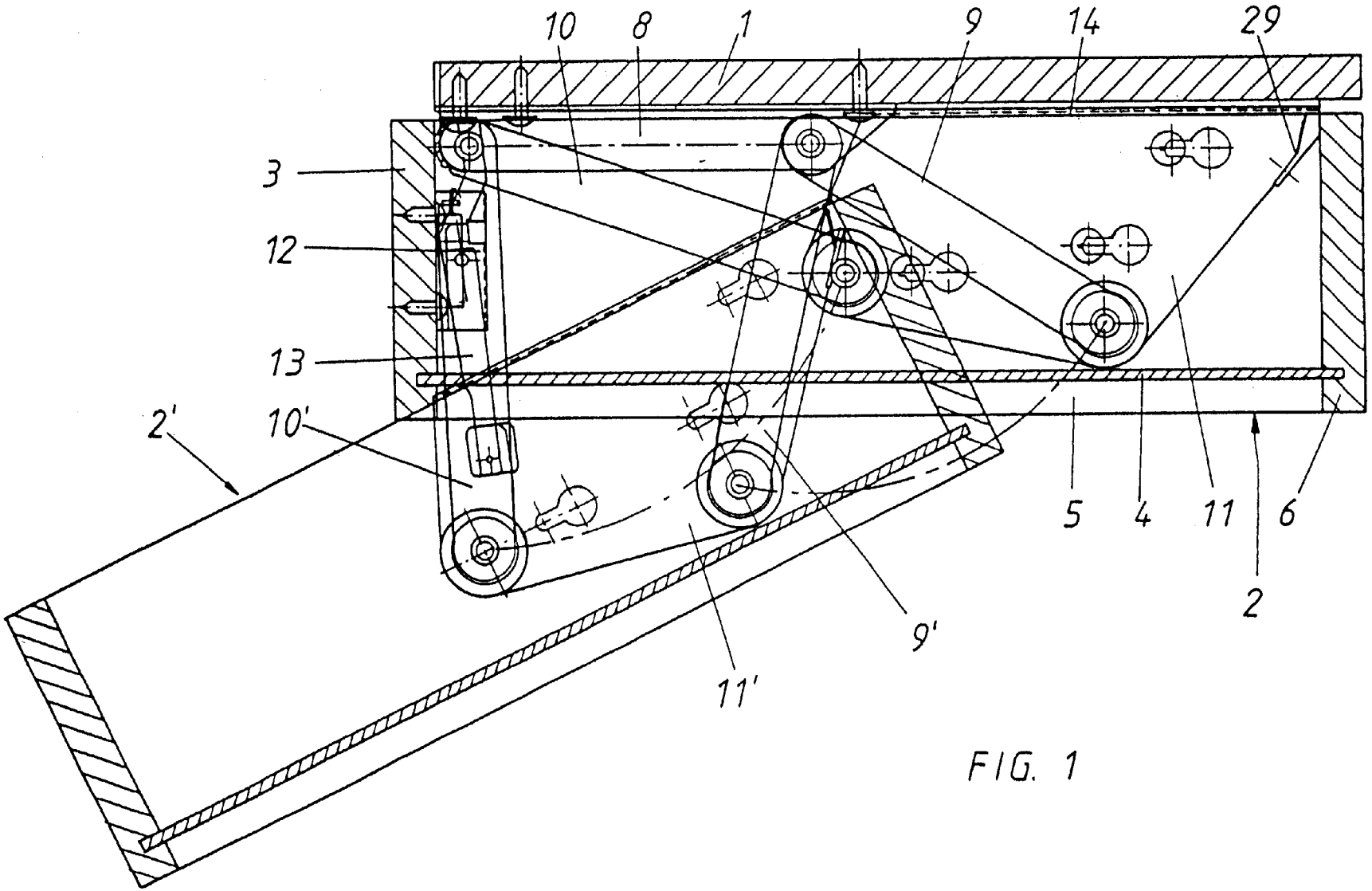
FIG. 1: a side section of the drawer that is fastened on the cabinet in the closed and opened position.
Figure 2:
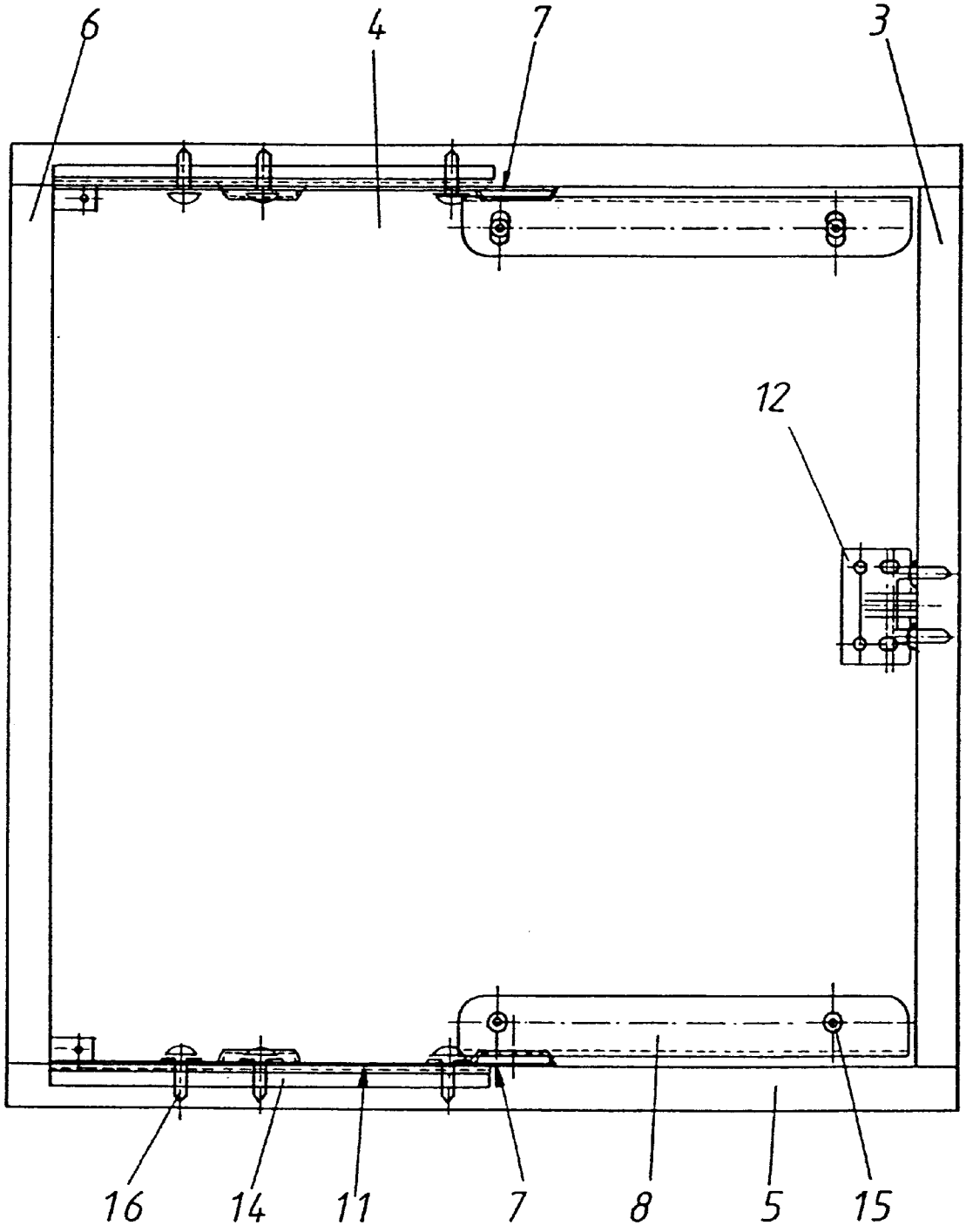
FIG. 2: an overview of the drawer with fastened assembly units and locking device.

As shown in FIGS. 1 and 2, the drawer (2) consists basically of a bottom component (4), two side walls (5), a front wall (3) and a back wall (6), which, together, form an upper open compartment.

Respective fittings in the form of assembly units (7) are fastened on the side walls (5) of the drawer (2), preferably, in the back area of the drawer, and are likewise, fastened to the underside of a cabinet. A bearing plate (11), on which two linkage rods in the form of a substantially parallelogram-like configuration and referred to herein as parallelogram arms (9, 10) are located, is fastened on the side walls (5) of the drawer (2). On the cabinet side, the assembly unit has a screw-down angle on which the parallelogram arms (9,10) are likewise linked, resulting in a parallelogram pull-out. The screw-down angles (8) are fastened preferably on the front underside of the cabinet (1), while, as has already been made know, the drawer-side bearing plates (11) are screwed down on the back inner side of the drawer. It is essential that the front parallelogram arms (10) are somewhat longer than the back parallelogram arms (10), so that the drawer is tilted conveniently towards the user when the drawer is in the open position.

First, the drawer (2) is in a closed position and fits on the cabinet (1) as shown in FIG. 1. The drawer is held in this position by a locking device (12) that is located on the front side (3) of the drawer and operates together with a cabinet-side closing angle.

When the drawer is opened, the parallelogram arms (9,10) swing towards the front and downward so that the drawer (2) moves away from the cabinet component (1) and on the front side, projects out from the cabinet (1). This is indicated in FIG. 1 by the drawer position 2' and the bearing plate position 11'. The parallelogram arms (9', 10') hang down somewhat vertical or perpendicular.

As clearly indicated in FIG. 2, the compartment-side bearing plates (11) are bent L-shaped up over the entire length forming the support shanks (14) that are on the upper edges of the side panels (6). This alignment of the assembly units and, respectively, the bearing plates (11) make the assembly easier. The L-shaped designed screw-down angles (8) have bore holes (15) by which they are fastened onto the underside of the cabinet (1). The bearing plates are inserted with screws (16) through corresponding bore holes or holes and are fastened on the inner side of the side walls (5) of the drawer (2).

Figure 5:
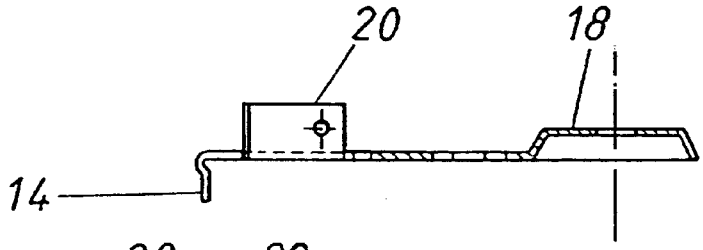
FIG. 5: a front view of the bearing plate.
Figure 4:
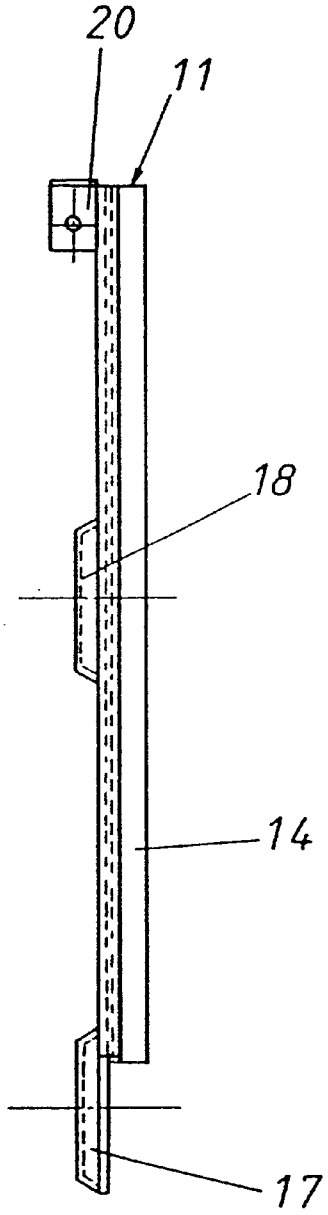
FIG. 4: an overview of the bearing plate.
Figure 3:
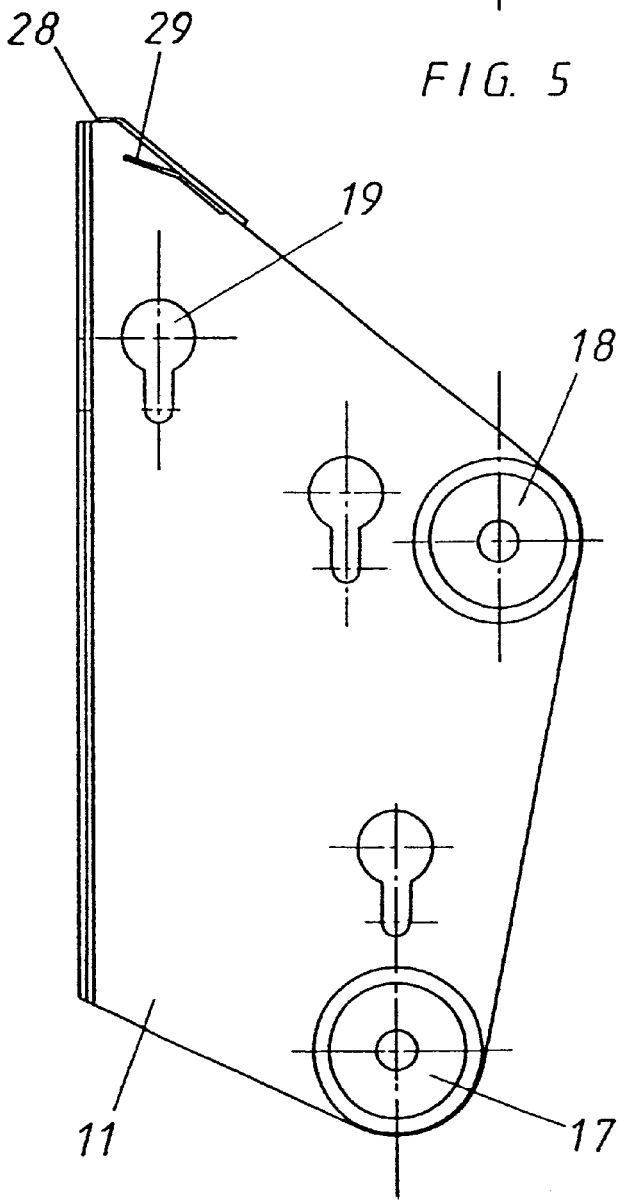
FIG. 3: a side view of the bearing plate.

FIGS. 3 to 5 more closely show the design of the bearing plate (11). The bearing plate (11) consists of a somewhat parallelogram-formed metal part with key holes (19) for fastening screws (16) on the side walls (5) of the drawer (2), as well as bearing points or fulcrums (17, 18) on which the parallelogram arms (9, 10) are linked. As already described above, the upper edge of the bearing plate (11) is folded, forming the support shank (14) that has already been described above. On the "corresponding" side of the parallelogram arms (9, 10), the bearing plate (11) has a bracket (20) on which a leaf spring (29) is located. This acts as an absorption or damping device in the drawer's (2) open position in that the back parallelogram arm (9') hits against the leaf spring (29) causing the absorption or damping. On the back edge in the area of the bracket (20), additionally, a stop edge (28) is provided that with the mounted bearing plate (11) fits on the back wall (6) of the drawer (2).

Figure 8:
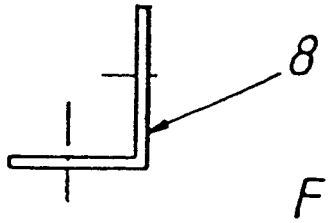
FIGS. 6 to 8: various views of the screw-down angle.
Figure 7:
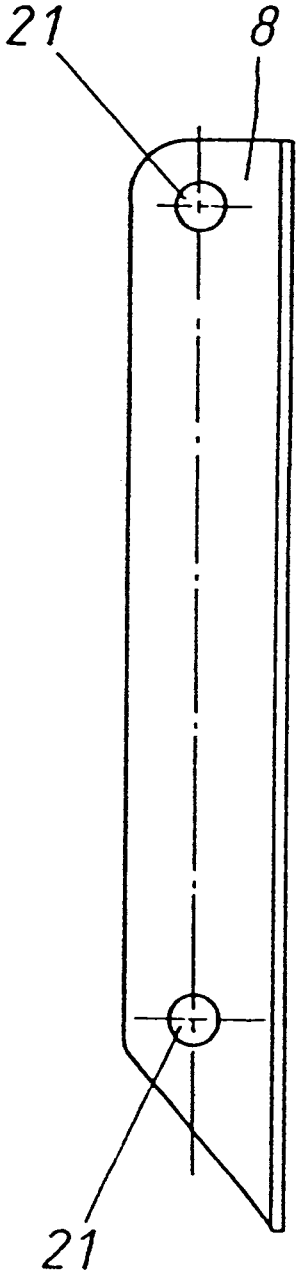
Figure 6:
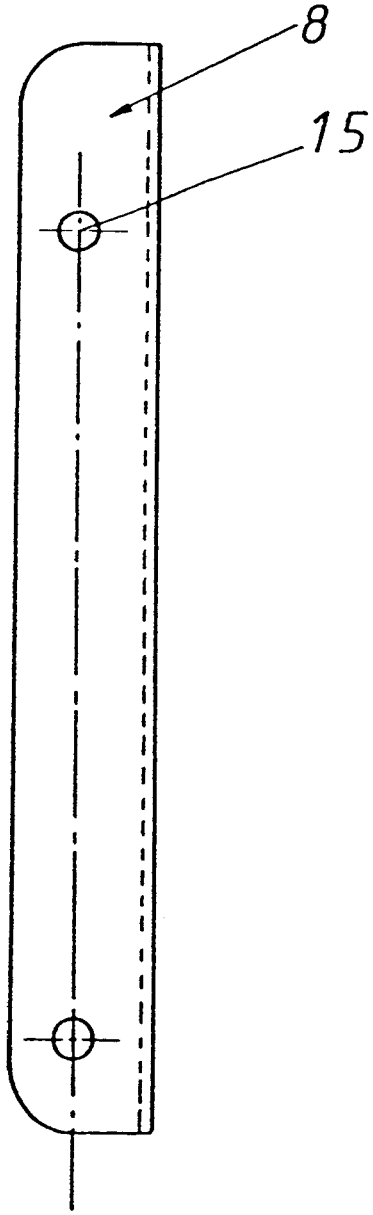
Figure 9:
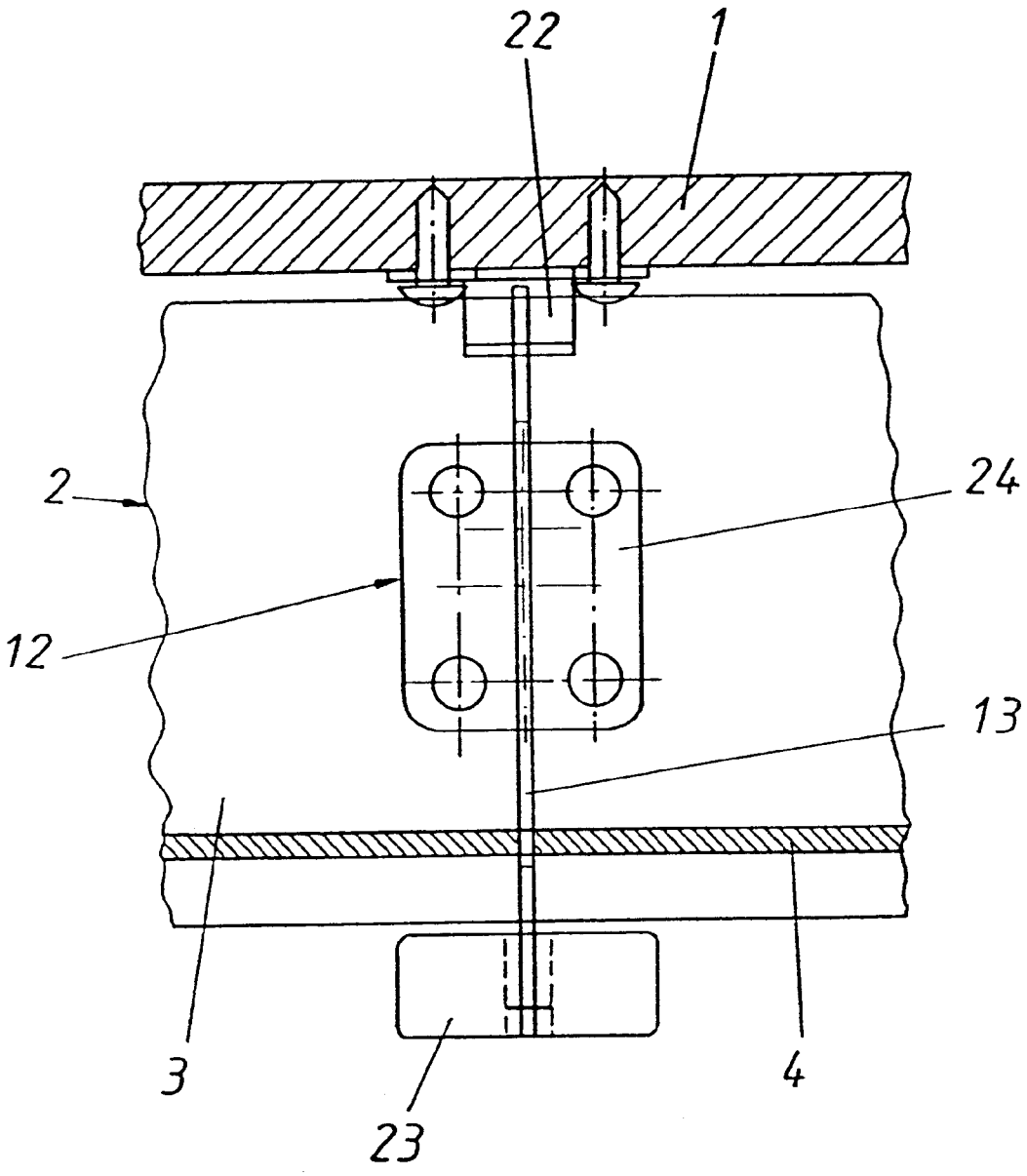
FIG. 9: a front view of the swinging drawer in the area of the locking device.
Figure 10:
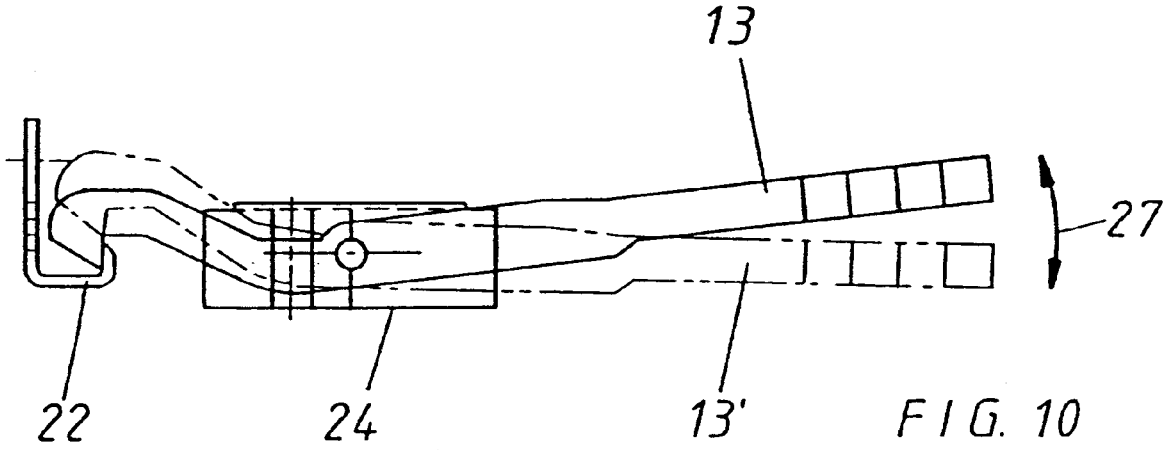
FIGS. 10 to 12: various views of the locking device respective to the catch lever.
Figure 11:
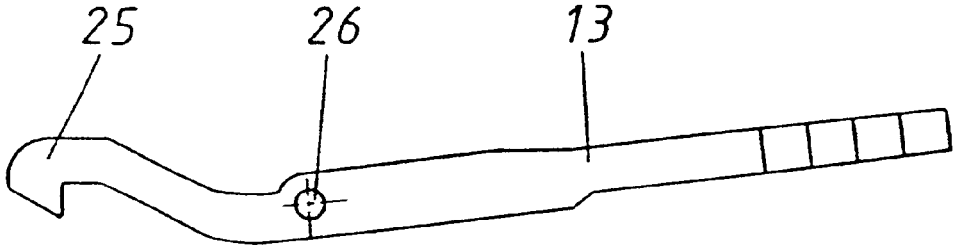
Figure 12:
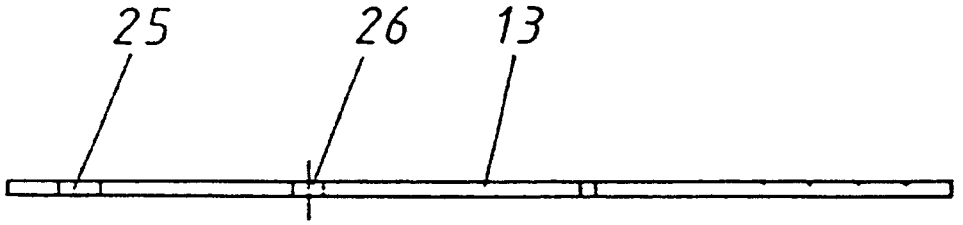

FIGS. 6 to 8 show various views of the screw-down angle (8), which is designed somewhat L-shaped so that a shank has a fulcrum (21) on which the parallelogram arm (9,10) is linked and the other shank has bore holes (15) by which the angle (8) is fastened to the underside of the cabinet.

The locking device (12) is more closely described in FIGS. 9 to 12.

The locking device (12) includes a rocker system (24) on the front wall (3) of the drawer. A catch lever (13) is held pivotable in this rocker system. The catch lever (13) extends somewhat vertically along the inner side of the front wall (3) so that the lower end is guided through the bottom (4) of the drawer (2) and projects downward over the bottom of the drawer. A handle (23) is located on this lower end to activate the catch lever (13).

In the upper area the catch lever (13) has a hook (25) (see FIG. 11) that works together with a closing angle (22), which is screwed securely to the underside of the cabinet (1). The closing angle (22) is likewise formed hook-shaped so that the hook (25) of the catch lever (13) engages in the angle (22), and the drawer stays securely in the closed position. As especially indicated in FIGS. 10 to 12, the catch lever (13) is held in the fulcrum (26) in the rocker system (24) and can be activated in arrow direction (27) so that the hook (25) of the catch lever (13) reaches beyond engagement with the closing angle (22) and the drawer can move down to its open position.

The locking mechanism is located preferably in the center of the drawer, but can, however, be located on only one or on both sides of the drawer and can be synchronized by a rod or linkage.

Drawing Legend

1. Cabinet
2. Drawer
3. Front wall
4. Bottom
5. Side wall
6. Back wall
7. Assembly unit
8. Screw-down angle
9. Parallelogram arm
10. Parallelogram arm
11. Bearing plate
12. Locking device
13. Catch lever
14. Support shank
15. Bore hole
16. Screw
17. Fulcrum
18. Fulcrum
19. Key hole
20. Bracket
21. Fulcrum
22. Closing angle
23. Handle
24. Rocker system
25. Hook
26. Fulcrum
27. Arrow direction
28. Stop edge
29. Leaf spring

What is claimed is:

1. A swinging drawer in the form of an upper open compartment adapted to be fastened on the underside of a cabinet piece such as a wall cabinet, the swinging drawer comprising at least one assembly unit located on at least one side wall of the swinging drawer, the assembly unit comprising a cabinet-side screw-down angle and a compartment-side bearing plate that are connected to each other by two parallelogram linkage arms, including a front parallelogram linkage arm and a back parallelogram linkage arm, wherein the front parallelogram linkage arm lies closer to a front wall of the swinging drawer and is longer than the back parallelogram linkage arm;

wherein the cabinet-side screw-down angle is adapted to be fastened to and supported on the underside of the cabinet piece with a front area of the screw-down angle disposed proximate a front edge of the cabinet piece, and the compartment-side bearing plate is adapted to be fastened to and support the swinging drawer with a rear area of the bearing plate disposed proximate a rear area of the swinging drawer;

wherein the front parallelogram linkage arm depends from the front area of the screw-down angle, and the back parallelogram linkage arm depends from a rear area of the screw-down angle which is spaced from the front area of the screw-down angle by a pre-defined distance; and wherein the rear area of the bearing plate is supported by the back parallelogram linkage arm, and a front area of the bearing plate that is spaced from the rear area of the bearing plate by a distance that is less than the pre-defined distance is supported by the front parallelogram linkage arm.

2. The swinging drawer, in accordance with claim 1, wherein one of the features selected from the group consisting of the length of the at least one parallelogram linkage arm, the position of a swivel connection to the screw-down angle of the at least one parallelogram linkage arm, and the position of a swivel connection to the bearing plate of the at least one parallelogram linkage arm allows the swinging drawer to be slightly tilted downward towards a user when the swinging drawer is in an open position.

3. The swinging drawer, according to claim 1, wherein the assembly units are located on each of two opposing side walls of the swinging drawer.

4. The swinging drawer, according to claim 1, wherein the at least one parallelogram linkage arm is provided with a counterweight in the form of a torsion spring.

5. The swinging drawer, according to claim 1, wherein the at least one parallelogram linkage arm is provided with a counterweight in the form of a draw spring.

6. The swinging drawer, according to claim 1, wherein the compartment-side bearing plate comprises a stop adapted to fit on the inner side of a back wall of said drawer; and a support shank on an upper edge of a side wall of the swinging drawer.

7. The swinging drawer, according to claim 1, further comprising an absorbing or damping stop when the swinging drawer is in an open position or a closed position.

8. The swinging drawer, according to claim 1, further comprising a locking device.

9. The swinging drawer, according to claim 8, wherein the locking device further comprising a hand-operated catch lever pivotally attached to a rocker system, wherein the catch lever engages a cabinet-side closing angle when the swinging drawer is closed.

10. The swinging drawer, according to claim 8, wherein the locking device is located substantially in the center of a front side of the swinging drawer.

11. A swinging drawer assembly unit, comprising:

a cabinet-side screw-down angle adapted to be fastened to and supported on an underside of a cabinet piece with a front area of the screw-down angle disposed proximate a front edge of the cabinet piece;

a compartment-side bearing plate adapted to be fastened to and support a swinging drawer with a rear area of the bearing plate disposed proximate a rear area of the swinging drawer;

two parallelogram linkage arms connecting the screw-down angle and the bearing plate to each other, including a front parallelogram linkage arm and a back parallelogram linkage arm, the front parallelogram linkage arm lying closer to a front wall of the swinging drawer and being longer than the back parallelogram linkage arm;

the front parallelogram linkage arm depending from the front area of the screw-down angle, and the back parallelogram linkage arm depending from a rear area of the screw-down angle which is spaced from the front area of the screw-down angle by a pre-defined distance; and the rear area of the bearing plate being supported by the back parallelogram linkage arm, and a front area of the bearing plate, spaced from the rear area of the bearing plate by a distance that is less than the pre-defined distance, being supported by the front parallelogram linkage arm.

* * * * *